US005709308A

United States Patent [19]

Gics

[11] Patent Number: 5,709,308

[45] Date of Patent: *Jan. 20, 1998

[54] FOOD PRODUCT CONTAINER INCLUDING A TRAY AND A JACKET AND AN ASSOCIATED FOOD PRODUCT PACKAGE

[75] Inventor: Paul W. Gics, Sewickley Heights, Pa.

[73] Assignee: Gics & Vermee, L.P., Sewickley, Pa.

[ * ] Notice: The term of this patent shall not extend beyond the expiration date of Pat. No. 5,492,703.

[21] Appl. No.: 469,956

[22] Filed: Jun. 6, 1995

[51] Int. Cl.[6] ..... B65D 1/34; B65D 85/00

[52] U.S. Cl. ..... 206/557; 40/312; 206/459.5; 220/315; 476/87; 476/106

[58] Field of Search ..... 40/312; 206/459.5, 206/557; 426/87, 106, 107; 220/346, 350, 351, 315

[56] References Cited

U.S. PATENT DOCUMENTS

| | | | |
|---|---|---|---|
| 3,126,660 | 3/1964 | Meyers | 40/312 |
| 3,160,326 | 12/1964 | Sturdevant et al. . | |
| 3,298,505 | 1/1967 | Stephenson . | |
| 3,372,856 | 3/1968 | Erhart et al. . | |
| 3,412,889 | 11/1968 | Eicholtz, Jr. | 40/312 X |
| 3,436,894 | 4/1969 | Sorenson . | |
| 3,449,183 | 6/1969 | Zelnick . | |
| 3,458,380 | 7/1969 | Kipp . | |
| 3,495,758 | 2/1970 | Wienecke, Jr. . | |
| 3,567,104 | 3/1971 | Arslanian et al. . | |
| 3,785,544 | 1/1974 | Smith . | |
| 3,863,832 | 2/1975 | Gordon et al. . | |
| 4,257,530 | 3/1981 | Faller . | |
| 4,351,473 | 9/1982 | Manizza . | |
| 4,373,636 | 2/1983 | Hoffman . | |
| 4,398,077 | 8/1983 | Freedman et al. . | |
| 4,531,668 | 7/1985 | Forbes, Jr. . | |
| 4,676,857 | 6/1987 | Scharr et al. . | |
| 4,713,510 | 12/1987 | Quick et al. . | |
| 4,763,790 | 8/1988 | McGeehins . | |
| 4,794,005 | 12/1988 | Swiontek . | |
| 4,831,224 | 5/1989 | Keefer . | |
| 4,841,112 | 6/1989 | Peleg . | |
| 4,870,233 | 9/1989 | McDonald et al. . | |
| 4,899,882 | 2/1990 | Benner . | |
| 4,916,280 | 4/1990 | Havette . | |
| 4,917,748 | 4/1990 | Harrison . | |
| 4,939,332 | 7/1990 | Hahn . | |
| 4,955,530 | 9/1990 | Rigby et al. . | |
| 4,994,638 | 2/1991 | Iorns et al. . | |
| 5,032,213 | 7/1991 | Thomas, Jr. . | |
| 5,039,833 | 8/1991 | Woods . | |
| 5,040,357 | 8/1991 | Ingemann . | |
| 5,090,615 | 2/1992 | Hopkins et al. . | |
| 5,126,518 | 6/1992 | Beckett . | |
| 5,234,159 | 8/1993 | Lorence et al. . | |
| 5,310,977 | 5/1994 | Stenkamp et al. . | |
| 5,326,575 | 7/1994 | Spaulding . | |
| 5,352,465 | 10/1994 | Gondek et al. . | |
| 5,356,649 | 10/1994 | LaMotta et al. . | |
| 5,366,102 | 11/1994 | Bergner et al. . | |
| 5,370,883 | 12/1994 | Saunier . | |
| 5,492,703 | 2/1996 | Gics | 426/87 |

FOREIGN PATENT DOCUMENTS

| | | |
|---|---|---|
| 0327243 | 8/1989 | European Pat. Off. . |
| 0399981 | 11/1990 | European Pat. Off. . |
| 0276654 | 3/1992 | European Pat. Off. . |
| 0492052 | 7/1992 | European Pat. Off. . |
| 2164868 | 8/1973 | France . |
| 2629424 | 10/1989 | France . |
| 2046060 | 5/1983 | United Kingdom . |
| 8604880 | 8/1986 | WIPO . |
| 8805249 | 7/1988 | WIPO . |
| 9105448 | 8/1991 | WIPO . |

*Primary Examiner*—Bryon P. Gehman
*Attorney, Agent, or Firm*—David V. Radack; Eckert Seamans Cherin & Mellott

[57] ABSTRACT

A food product container including a tray having a base and a sidewall extending from the base and a jacket disposed generally adjacent to the tray. The sidewall of the tray terminates in a flange which together with a portion of the sidewall defines an undercut space. The jacket is dimensioned such that a portion thereof is disposed in the undercut space so that the Jacket can be restrained from separating from adjacent the tray by virtue of the portion engaging against the flange. An associated food product package is also disclosed.

19 Claims, 5 Drawing Sheets

FOOD PRODUCT CONTAINER INCLUDING A TRAY AND A JACKET AND AN ASSOCIATED FOOD PRODUCT PACKAGE

BACKGROUND OF THE INVENTION

This invention relates to a food product container including a tray and a jacket surrounding the tray and an associated food product package, and more particularly to a tray including a flange which defines an undercut space in which a portion of the jacket is disposed so that the jacket does not separate from adjacent the tray.

A food product container, in addition to performing its main function of containing the food product, must also include surfaces on which informational and marketing indicia are printed. With the advent of plastic trays to contain the food product, there is the need to provide a paperboard sleeve or jacket to contain the necessary informational and marketing indicia. This indicia includes government mandated information, such as, for example, nutritional information, as well as attractive graphics in order to entice the consumer to purchase the product.

There have been suggested certain containers that include a tray and jacket surrounding the tray. U.S. Pat. No. 3,785,544, for example, discloses a plastic tray surrounded by a paperboard jacket. The jacket includes flanged portions which have a hot-melt adhesive disposed thereon in order to seal the same to the lower surface of the tray rim.

Problems arise with the prior art designs when it is necessary to assemble the jacket and the tray to form the container at the extremely high speeds that are commercially viable. It is difficult to effectively secure the jacket to the tray by using a hot-melt adhesive that is disposed near the free edge of the jacket. This is because there needs to be a solid supporting surface for the tray rim in order to effectively bring together the tray and the jacket. This requires the use of dies and sealing anvils that must be perfectly indexed at high speeds. As can be expected, this process does not always run smoothly, leading to inefficiencies in production and excess scrapping of materials.

Therefore, what is needed is a food product container including a tray and a jacket in which the jacket can be easily and effectively placed into the tray in order to form an attractive, commercially viable food product container.

SUMMARY OF THE INVENTION

The invention has met or exceeded the above-captioned need as well as others. A food product container is disclosed which includes a tray having a base and a sidewall extending from the base and a jacket disposed generally adjacent to the tray. The sidewall of the tray terminates in a flange which together with a portion of the sidewall defines an undercut space. The jacket is dimensioned such that a portion thereof is disposed in the undercut space so that the jacket can be restrained from separating from adjacent the tray by means of the portion engaging against the flange.

A food package is also disclosed which includes the food product container described above and further including a lid secured to the tray in order to enclose the food product in the food package.

BRIEF DESCRIPTION OF THE DRAWINGS

A full understanding of the invention can be gained from the following detailed description of the invention when read in conjunction with the accompanying drawings in which.

DETAILED DESCRIPTION

Figure 1:
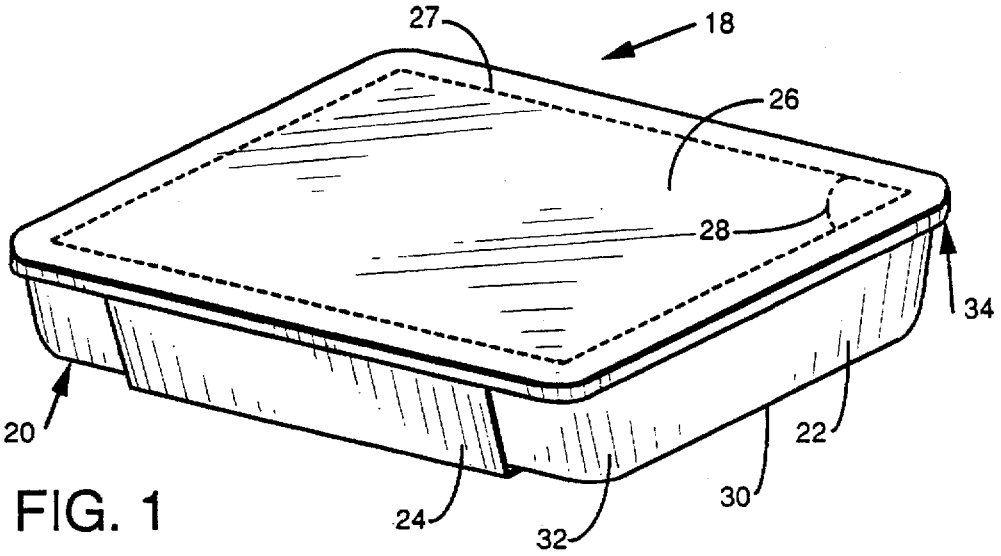
FIG. 1 is a perspective view of a food product package including a tray, a jacket and a lid.
Figure 2:
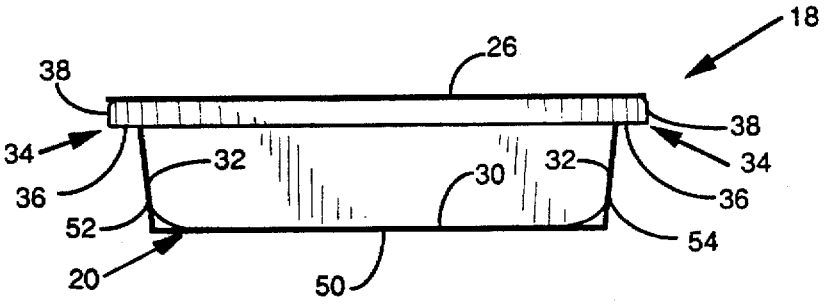
FIG. 2 is a side elevational view of the food product package of FIG. 1.
Figure 3:
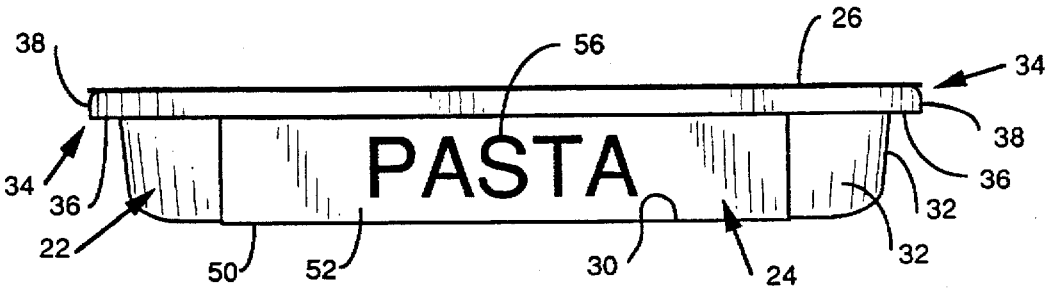
FIG. 3 is a front elevational view of the food product package of FIG. 1.
Figure 4:
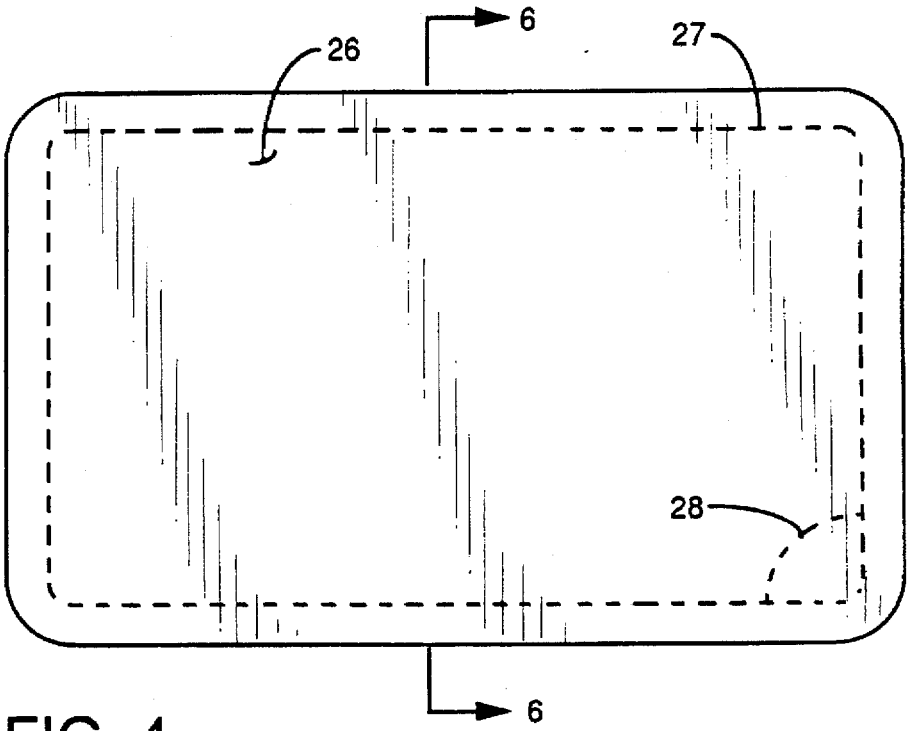
FIG. 4 is a top plan view of the food product package of FIG. 1.
Figure 5:
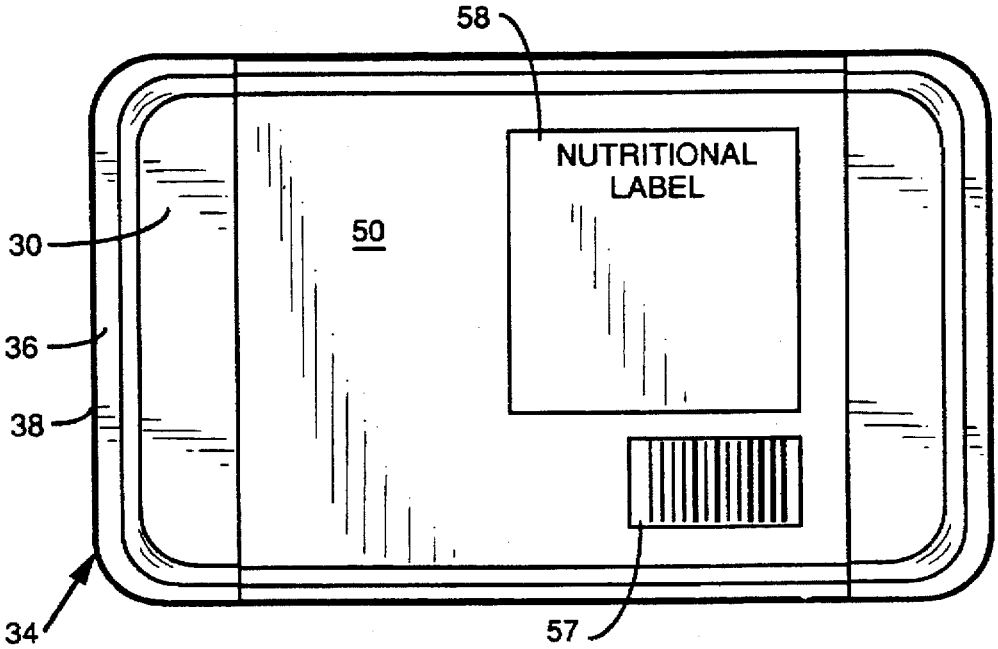
FIG. 5 is a bottom plan view of the food product package of FIG. 1.

Referring to FIG. 1, a food package 18 in accordance with the invention is shown. The food package 18 includes a food product container 20 which is formed by a tray 22 and a jacket 24 disposed generally adjacent to the tray 22. The food package 20 also includes a lid 26 sealed to the tray 22. The lid 26 is removed from the tray 22 with the aid of score line 27 which is disposed around the perimeter of the lid 26. Preferably, a finger tab is provided by score line 28 in order to facilitate removal of the lid 26.

Preferably, the tray 22 is made of plastic and, more particularly, crystallized polyethylene terephthalate ("C-PETE"). The jacket 24 and lid 26 are preferably made of a paper product, such as paperboard. It will be appreciated, however, that the invention contemplates any type of material composition for the tray 22, jacket 24 and lid 26.

As can be seen in FIGS. 2, 3 and 5–7, the jacket 24 is disposed generally adjacent to and partially surrounds the tray 22. The tray 22 itself consists of a base 30 and a sidewall 32 extending from the base 30. The sidewall 32 includes a flange 34 consisting of a first portion 36 extending generally perpendicularly from the sidewall 32 and a second portion 38 extending generally perpendicularly from the first portion 36.

The jacket 24 includes a bottom flap 50 and two side flaps 52, 54. The jacket 24 contains food product indicia, such as the indicia "PASTA" 56 that can be placed anywhere on the exposed surface of the jacket 24. Other indicia, such as bar code indicia 57 and nutritional information indicia 58 can be placed on the bottom flap 50. It can be seen that the jacket 24 provides a large amount of surface area upon which the indicia can be placed. The jacket 24 can be formed as flat blank and then folded or otherwise positioned generally adjacent to the tray 22 as shown in FIGS. 1–7.

Figure 6:
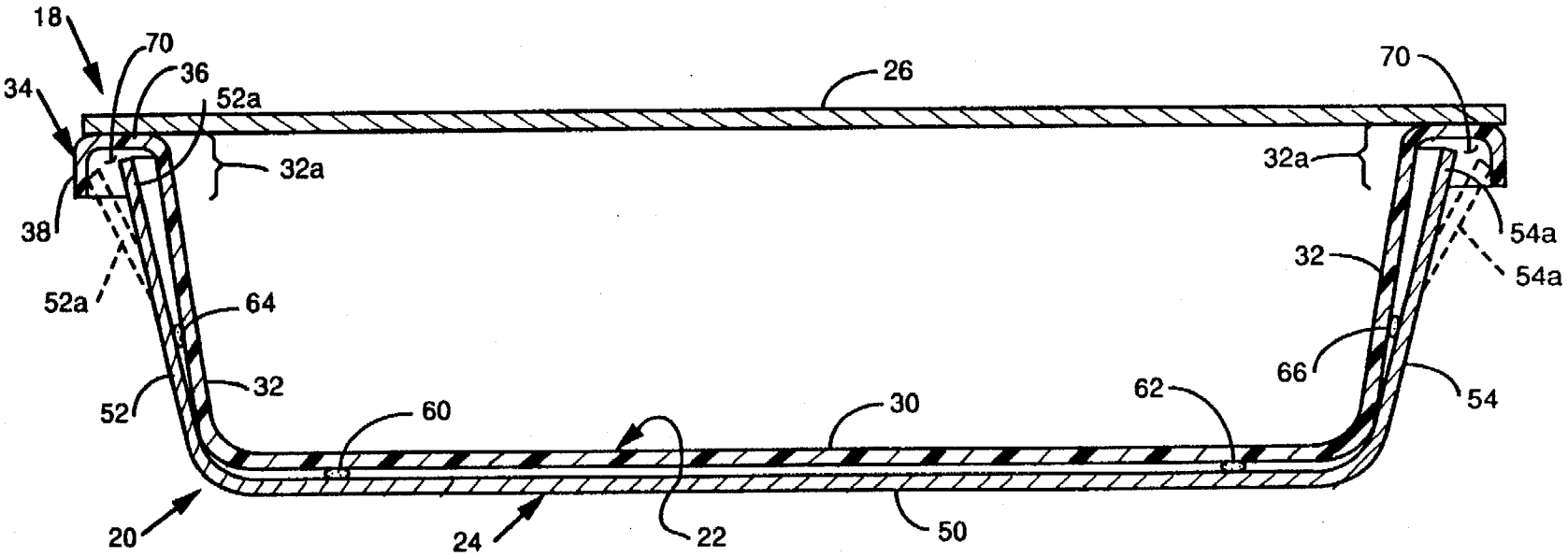
FIG. 6 is a vertical section of the food product package of FIG. 1.
Figure 7:
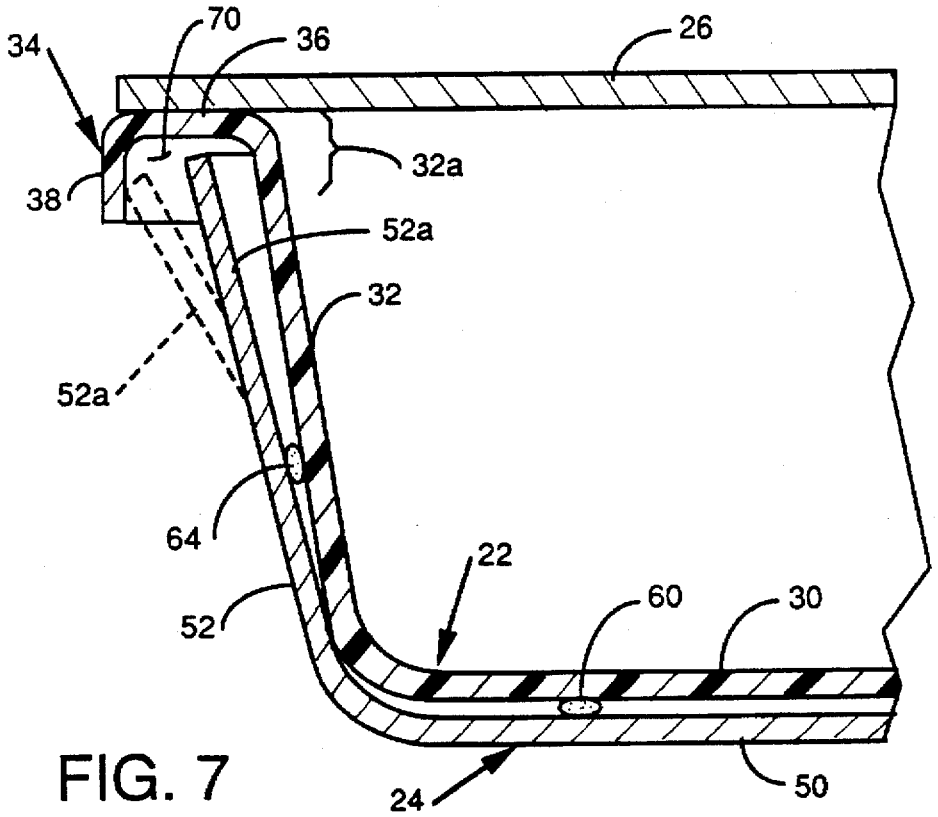
FIG. 7 is a detailed view of a portion of the vertical section shown in FIG. 6.

Referring specifically to FIGS. 6 and 7, the jacket 24 is secured to the tray 24 by securing a portion of the bottom flap 50 of the jacket 24 to the base 30 of the tray 24. This can be accomplished by any means known to those skilled in the art, and is shown in FIGS. 6 and 7 as providing spots (only two shown) of adhesive 60, 62 which are deposited on the base 30 and then which secure the bottom flap thereto. It will be appreciated that any type of adhesive can be used, such as a hot-melt adhesive. The adhesive can be deposited as a spot or can be deposited as a stripe of adhesive. The adhesive can be positioned at any desired area on the base 30 of the tray 22.

FIGS. 6 and 7 also show spots of adhesive 64 and 66 securing respective side flaps 52, 54 to the sidewall 32. It will be appreciated that either the side flaps 52, 54 or the bottom flap 50 or both the side flaps 52, 54 and the bottom flap 50 can be secured to the tray 22 and still be within the scope of the invention.

Referring further to FIGS. 6 and 7, it will be seen that the jacket 24 is positioned and dimensioned such that free edge portions 52*a* and 54*a* of the side flaps 52 and 54 are disposed in an undercut space 70 defined by the flange 34 and sidewall 32, and more particularly by the first portion 36 and second portion 38 of the flange 34 and portion 32*a* of the sidewall 32. In this way, the free edge portions 52*a* and 54*a* and thus the side flaps 52 and 54 can be restrained from separating from a position adjacent the sidewall 32 of the tray 22. This restraining feature is shown by the phantom line drawing of free edge portion 52*a* in FIGS. 6 and 7. As can be seen in these figures, if the free edge portion 52*a* starts to move away from its position shown in solid line drawings in FIGS. 6 and 7, it will be restrained from further separating from the tray 22 by contacting second portion 38 of flange 34. It will be appreciated that it is not necessary for the free edge portion 52*a* to be initially positioned so that contact is made with the second portion 38 of flange 34. In fact, the positioning of the free edge portion 52*a* shown in solid line drawing of FIGS. 6 and 7 is preferred. However, the jacket 24 should be positioned and dimensioned such that if a separating movement of the free edge portion 52*a* arises, the second portion 38 of the flange 34 will restrain further movement of the side flap 52 away from the sidewall 32 of the tray 22, and thus avoid the problem of having a loose side flap 52, which is not adjacent to the sidewall 32.

It will be appreciated that with the arrangement shown in FIGS. 1–7, that there is no need to secure the free edge portions 52*a* and 54*a* to the flange 34. In fact, if it is desired to secure the side flap to the sidewall, a portion of the side flap other than free edge portions 52*a* and 54*a* should be adhesively secured to the tray. This advantageous because of the inherent difficulty in accomplishing securement of the free edge portion 52*a* in undercut space 70. In order to accomplish that securement, specialized securing equipment, including sealing dies and anvils, must be provided to fit into undercut space 70. As can further be appreciated, there is a small tolerance to accomplish that securement, and when in production, because hundreds of these food packages must be made, this small tolerance can lead to rejects and scrap, thus adversely effecting productivity. In the food product package 18 of the invention, however, there is no need for securement of the free edge portions 52*a* and 54*a* to the tray, thus avoiding the abovementioned problems. Another advantage of the invention over prior art packages is that the jacket 24 is easier to remove from the tray 22 when the consumer desires to cook the food product. This is because the side flap is not secured to the flange, but instead, if secured at all, is secured nearer to the bottom of the tray. This makes the jacket easier to remove from the tray.

It will further be appreciated that the flange 34 shown in FIGS. 1–7 is for illustrating a preferred embodiment of the tray 22. The invention contemplates any form of flange that, along with the sidewall of the tray, defines an undercut space in which a portion of the jacket is disposed. For example, the flange could merely consist of a portion that extends outwardly and angularly from the sidewall, forming an undercut space having a "V-shaped" cross-section. The key point is that the flange forms a restraining means for restraining a properly dimensioned and positioned jacket from separating from adjacent the tray, and more particularly, from adjacent the sidewall of the tray.

Figure 8:
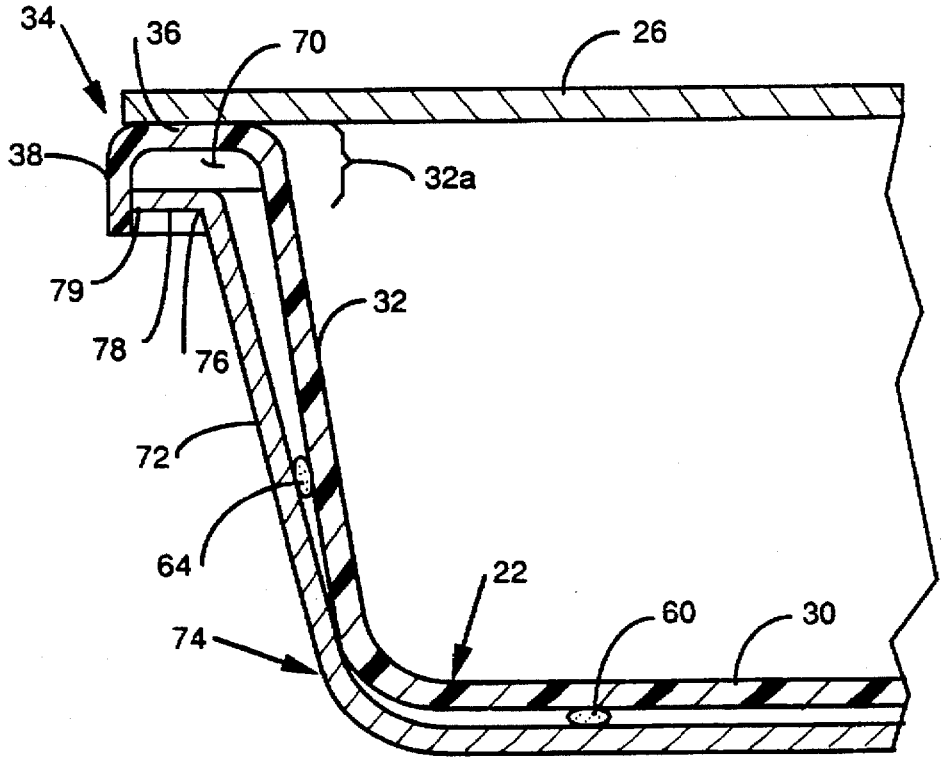
FIG. 8 is a view similar to FIG. 7, only showing an alternate embodiment of a jacket.
Figure 9:
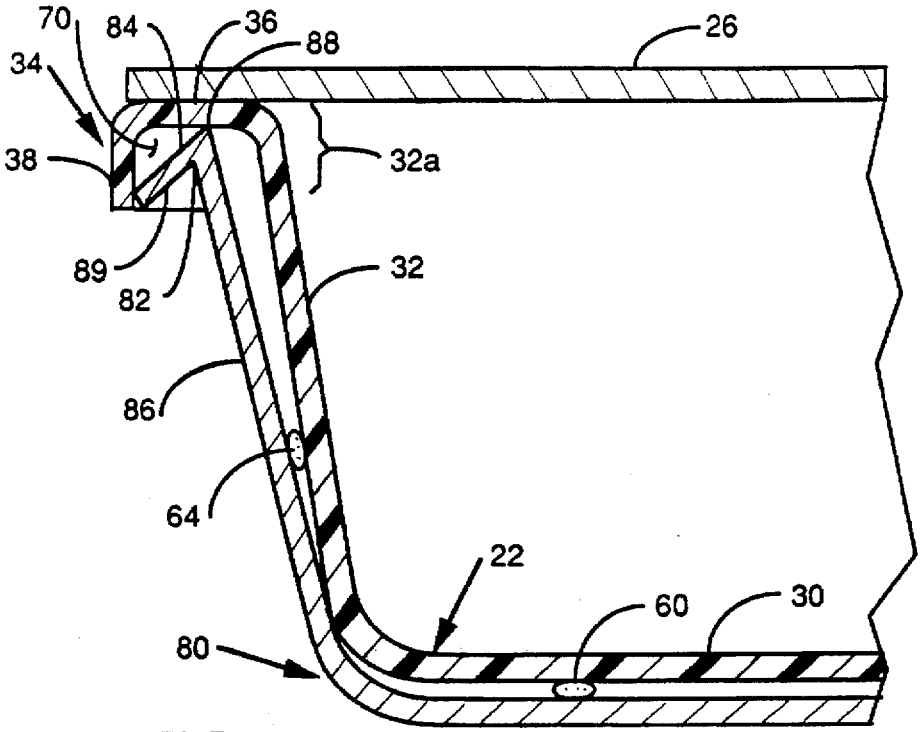
FIG. 9 is a view similar to FIG. 7, only showing another alternate embodiment of a jacket.
Figure 10:
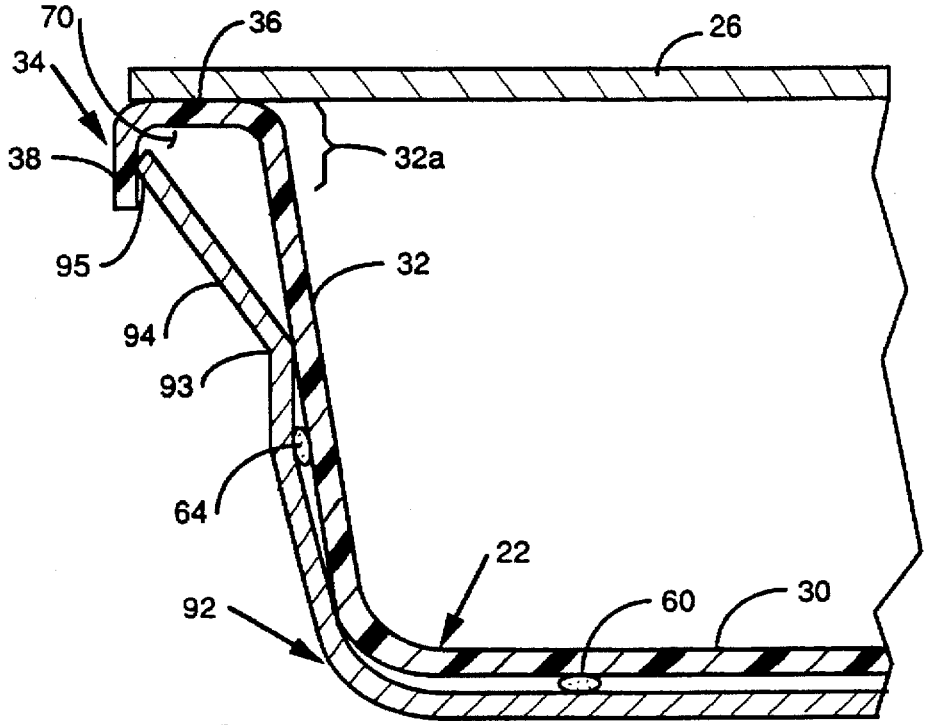
FIG. 10 is a view similar to FIG. 7, only showing yet another alternate embodiment of a jacket.

FIGS. 8–10 show alternate embodiments of the structure of the jacket, wherein like reference characters to those used in FIGS. 1–7 show like features of these embodiments. In FIG. 8, the side flap 72 of the jacket 74 includes a fold line 76 that separates a generally horizontally extending portion 78 from the remainder of the side flap 72. This portion 78 is disposed in the undercut space 70 and thus can be restrained from separating from adjacent the sidewall 32 by second portion 38 of the flange 34. Although portion 78 is shown in FIG. 8 as having a free edge 79 contacting second portion 38, it will be appreciated that, as with the embodiment of the jacket 24 shown in FIGS. 1–7, the portion 78 can be positioned so that free edge 79 is initially not in contact with second portion 38, but, when a separating movement arises, the free edge 79 and/or portion 78 and thus side flap 72 can be restrained from separating from adjacent the sidewall 32.

In FIG. 9, the jacket 80 has a fold line 82 that creates a portion 84 that extends generally angularly from the remainder of the side flap 86. FIG. 9 shows that a portion 88 of the side flap 86 containing the fold line 82 contacts the first portion 36 of the flange 34 and a free edge portion 89 of the side flap 86 contacts the second portion 38 of the flange 34. As with all of the embodiments, this does not necessarily have to bet he initial positioning of the side flap 86 in the undercut space 70. One, both or neither of portion 88 and free edge portion 89 can contact first portion 36 of flange 34 and second portion 38 of flange 34, respectively. The key point is that a portion of the side flap must be positioned in the undercut space so that the jacket can be restrained from separating from adjacent the tray.

Yet another embodiment of a jacket 92 is shown in FIG. 10. In this embodiment, the side flap 92 has a fold line 93 that a creates portion 94 that extends angularly from the remainder of the side flap 92. A portion 94 of the side flap 92 containing the fold line 93 contacts the sidewall 32 of the tray 22. The free edge portion 95 of the angularly extending portion 94 is disposed in the undercut space 70 and is shown contacting the second portion 38 of the flange 34. Once again, the free edge portion 95 can be positioned so as to not contact the second portion 38 of the tray 22, but is able to be restrained thereby once a separating movement arises.

It will be appreciated that a food product package and a food product container have been disclosed in which the food product container includes a tray and a jacket, the tray including a flange which defines an undercut space in which a portion of the jacket is disposed so that the jacket does not separate from adjacent the tray. This arrangement permits high speed manufacture of the food product container, while insuring that the jacket stays adjacent to the tray during shipping, handling and consumer transporting and use of the food product.

While specific embodiments of the invention have been disclosed, it will be appreciated by those skilled in the art that various modifications and alterations to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A food product container comprising:

a tray having a base and a sidewall extending from said base, said sidewall terminating in a flange which together with a portion of said sidewall defines an undercut space; and a jacket disposed generally adjacent said tray, said jacket including a bottom flap disposed adjacent said base and a side flap disposed adjacent said sidewall, said side flap terminating in a free edge portion and said jacket being positioned and dimensioned such that said free edge portion of said side flap is substantially disposed in said undercut space wherein said jacket can be restrained from separating from adjacent said tray by means of said free edge portion engaging against said flange.

2. The container of claim 1, wherein a portion of said jacket other than said portion disposed in said undercut space is adhesively secured to said tray.

3. The container of claim 2, wherein said bottom flap is secured to said base.

4. The container of claim 2, wherein said side flap is secured to said sidewall.

5. The container of claim 2, wherein said bottom flap is secured to said base; and said side flap is secured to said sidewall.

6. The container of claim 1, wherein said flange includes a first portion extending generally perpendicularly from said sidewall and a second portion extending generally perpendicularly from said first portion.

7. The container of claim 6, wherein said side flap includes a fold line that forms a free end section extending from the remainder of said side flap, said free end section including said portion disposed in said undercut space.

8. The container of claim 7, wherein said free end section includes a free edge.

9. The container of claim 8, wherein said free edge contacts said flange.

10. The container of claim 9, wherein said free end section extends generally perpendicularly from said sidewall.

11. The container of claim 9, wherein said free end section extends generally angularly from the remainder of said side flap.

12. The container of claim 11, wherein said fold line contacts said first portion.

13. The container of claim 11, wherein said fold line contacts said sidewall.

14. The container of claim 1, wherein said tray is made of plastic.

15. The container of claim 14, wherein said tray is made of C-PETE.

16. The container of claim 1, wherein said jacket is made of paperboard.

17. A food package comprising:

a food product container including:

a tray having a base and a sidewall extending from said base, said sidewall terminating in a flange which together with a portion of said sidewall defines an undercut space; and a jacket disposed generally adjacent said tray, said jacket including a bottom flap disposed adjacent said base and a side flap disposed adjacent said sidewall, said side flap terminating in a free edge portion and said jacket being positioned and dimensioned such that said free edge portion of said side flap is substantially disposed in said undercut space wherein said jacket can be restrained from separating from adjacent said tray by means of said free edge portion engaging against said flange; and a lid sealed to a portion of said tray in order to enclose said food product in said food package.

18. The food package of claim 17, wherein said lid has score lines to facilitate removal of said lid from said food package.

19. The food package of claim 18, wherein said score lines define a finger tab to further facilitate removal of said lid from said food package.

* * * * *